US006484452B2

(12) United States Patent
Yen

(10) Patent No.: US 6,484,452 B2
(45) Date of Patent: Nov. 26, 2002

(54) SELF-OPENING/CLOSING UMBRELLA

(75) Inventor: Huo-Huang Yen, Taoyuan (TW)

(73) Assignee: Yu-Chou Chen, Taoyuan (TW)

( * ) Notice: Subject to any disclaimer, the term of this patent is extended or adjusted under 35 U.S.C. 154(b) by 0 days.

(21) Appl. No.: 09/816,617

(22) Filed: Mar. 23, 2001

(65) Prior Publication Data

US 2002/0134413 A1 Sep. 26, 2002

(51) Int. Cl.[7] ..... A45B 25/14

(52) U.S. Cl. ..... 52/24; 52/25.4; 52/25.34; 52/31

(58) Field of Search ..... 135/22, 24, 25.4, 135/40, 29, 31, 25.34, 25.32, 27

(56) References Cited

U.S. PATENT DOCUMENTS

| | | | | | |
|---|---|---|---|---|---|
| 872,518 | A | * | 12/1907 | Johnson | 135/25.34 |
| 1,320,327 | A | * | 10/1919 | Greenwald | 135/25.2 |
| 1,397,667 | A | * | 11/1921 | Wilson | 135/25.34 |
| 3,003,508 | A | * | 10/1961 | Bremshey | 135/23 |
| 4,421,133 | A | * | 12/1983 | Huang | 135/22 |
| 4,825,888 | A | * | 5/1989 | Su | 135/22 |
| 5,224,505 | A | * | 7/1993 | Wu | 135/24 |
| 5,275,186 | A | * | 1/1994 | Liu | 135/24 |
| 5,297,571 | A | * | 3/1994 | Chu et al. | 135/24 |
| 5,836,328 | A | * | 11/1998 | Lee | 135/25.2 |

FOREIGN PATENT DOCUMENTS

| | | | | |
|---|---|---|---|---|
| GB | 2240038 | * | 7/1991 | 135/23 |

* cited by examiner

*Primary Examiner*—Lanna Mai
*Assistant Examiner*—Winnie Yip

(57) ABSTRACT

A self-opening/closing umbrella comprises a handle, an outer tube, a middle tube partially mounted in the outer tube and including a lower end securely attached to the handle and an upper end in the outer tube. and an inner tube partially mounted in the middle tube and including a lower end in the middle tube and an upper end extending beyond the middle tube and the outer tube. A rib-mounting base is securely mounted to the upper end of the inner tube to move therewith. A stretcher-mounting runner is securely mounted to the upper end of the outer tube to move therewith, the runner being slidably mounted around the inner tube. A compression spring is attached between the runner and the upper end of the middle tube. When an opening button is pushed, the runner and the outer tube are moved upward under a first stage of extension of the compression spring, thereby opening the umbrella. When the closing button is pushed while the umbrella is in the open state, the base and the inner tube are moved upward under a second stage of extension of the compression spring, thereby closing the umbrella.

16 Claims, 7 Drawing Sheets

SELF-OPENING/CLOSING UMBRELLA

BACKGROUND OF THE INVENTION

1. Field of the Invention

The present invention relates to a self-opening/closing umbrella that uses only one spring for opening and closing the umbrella.

2. Description of the Related Art

An umbrella is generally used to shield people from rain or sunshine. A conventional umbrella requires the user to manually open and close it. Self-opening umbrellas have been designed, which umbrellas can be opened by pushing a button. Thereafter, self-opening/closing umbrellas have been developed in view of the inconvenience in manual closing for the self-opening umbrellas. However, the self-opening/closing umbrellas have very complicated structures and include at least one spring for opening the umbrella and several springs for closing the umbrella. Manufacture and assembly of the numerous elements for the umbrellas are costly.

SUMMARY OF THE INVENTION

It is the primary object of the present invention to provide an improved self-opening/closing umbrella that uses only one spring for opening and closing the umbrella.

A self-opening/closing umbrella in accordance with the present invention comprises:

a handle;

an outer tube mounted outside the handle and including a lower end and an upper end, the outer tube including a first radial hole;

a middle tube partially mounted in the outer tube and including a lower end securely attached to the handle and an upper end in the outer tube, the middle tube including a second radial hole and a third radial hole;

an inner tube partially mounted in the middle tube and including a lower end in the middle tube and an upper end extending beyond the middle tube and the outer tube, the inner tube including a fourth radial hole;

a base securely mounted to the upper end of the inner tube to move therewith, a plurality of ribs each having an end pivotally connected to the base;

a runner securely mounted to the upper end of the outer tube to move therewith, the runner being slidably mounted around the inner tube;

a compression spring attached between the runner and the upper end of the middle tube;

a first hook pivotally mounted to the handle and including a hooked end;

an opening button mounted to the handle and operably connected to the first hook;

a second hook pivotally mounted to the handle and including a hooked end:

a closing button mounted to the handle and operably connected to the second hook;

wherein when the umbrella is in a closed state, the compression spring is compressed, the hooked end of the first hook is engaged in the first radial hole of the outer tube and the second radial hole of the middle tube, the hooked end of the second hook is engaged in the third radial hole of the middle tube and the fourth radial hole of the inner tube;

wherein when the opening button is pushed, the hooked end of the first hook is disengaged from the second radial hole of the middle tube, the runner and the outer tube are moved upward under a first stage of extension of the compression spring, thereby opening the umbrella to an open state; and wherein when the closing button is pushed while the umbrella is in the open state, the hooked end of the second hook is disengaged from the fourth radial hole of the inner tube, the base and the inner tube are moved upward under a second stage of extension of the compression spring, thereby closing the umbrella.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
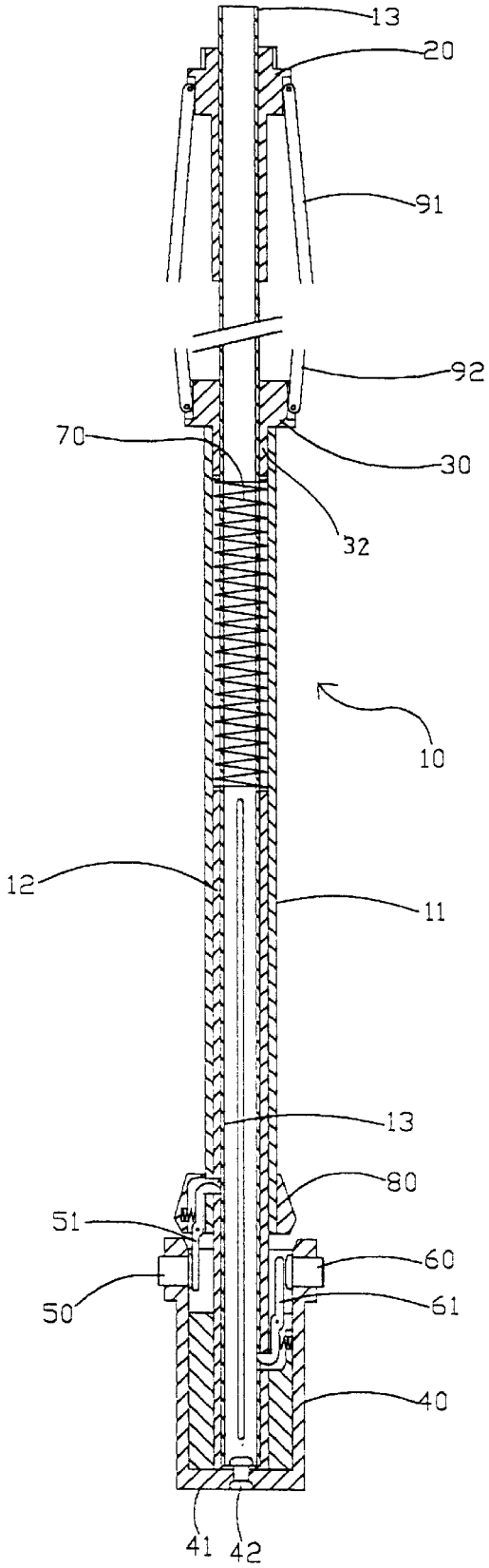
FIG. 1 is a sectional view of a self-opening/closing umbrella in accordance with the present invention ma closed state.
Figure 2:
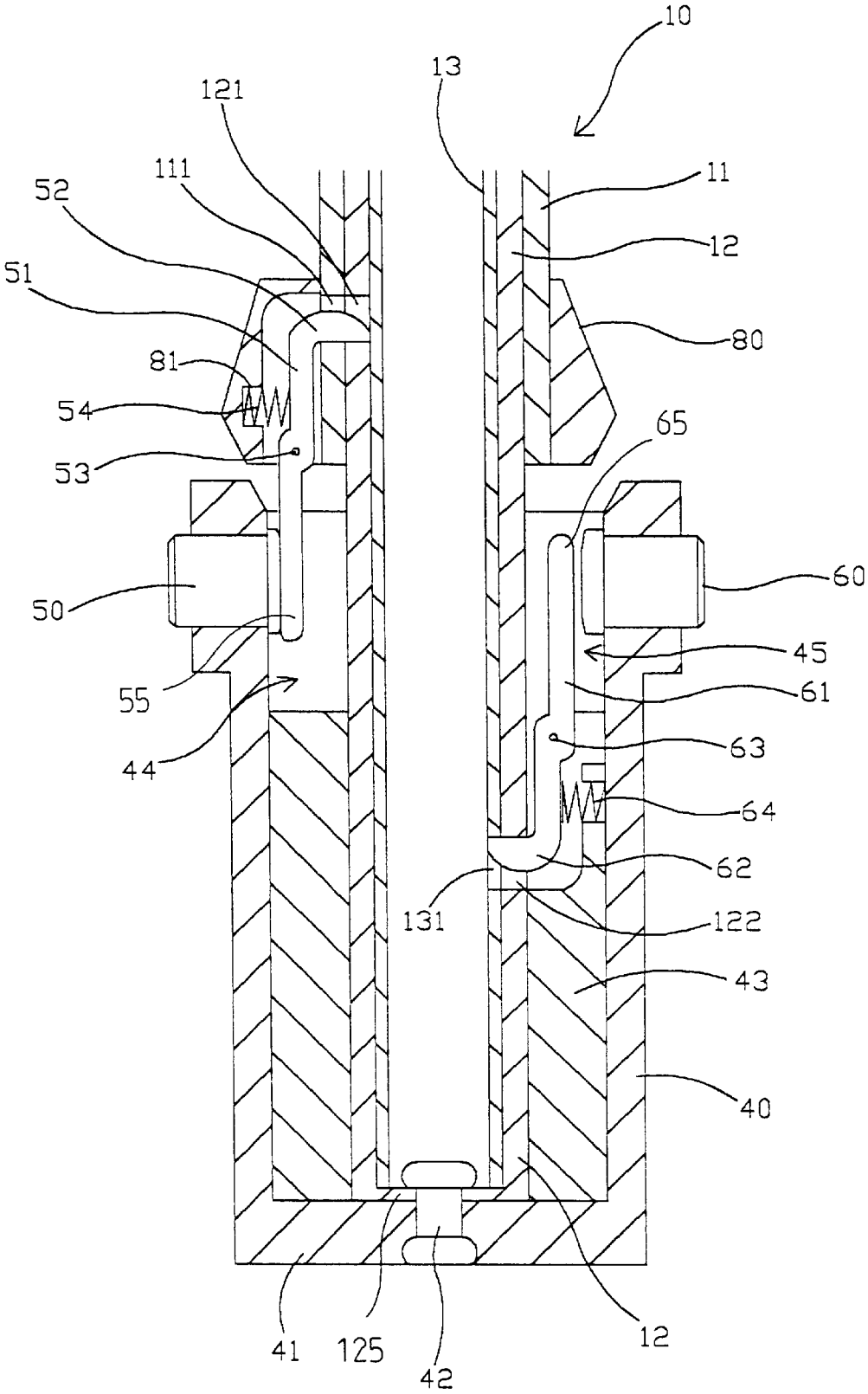
FIG. 2 is an enlarged view of a handle portion of the self-opening/closing umbrella in accordance with present invention.
Figure 4:
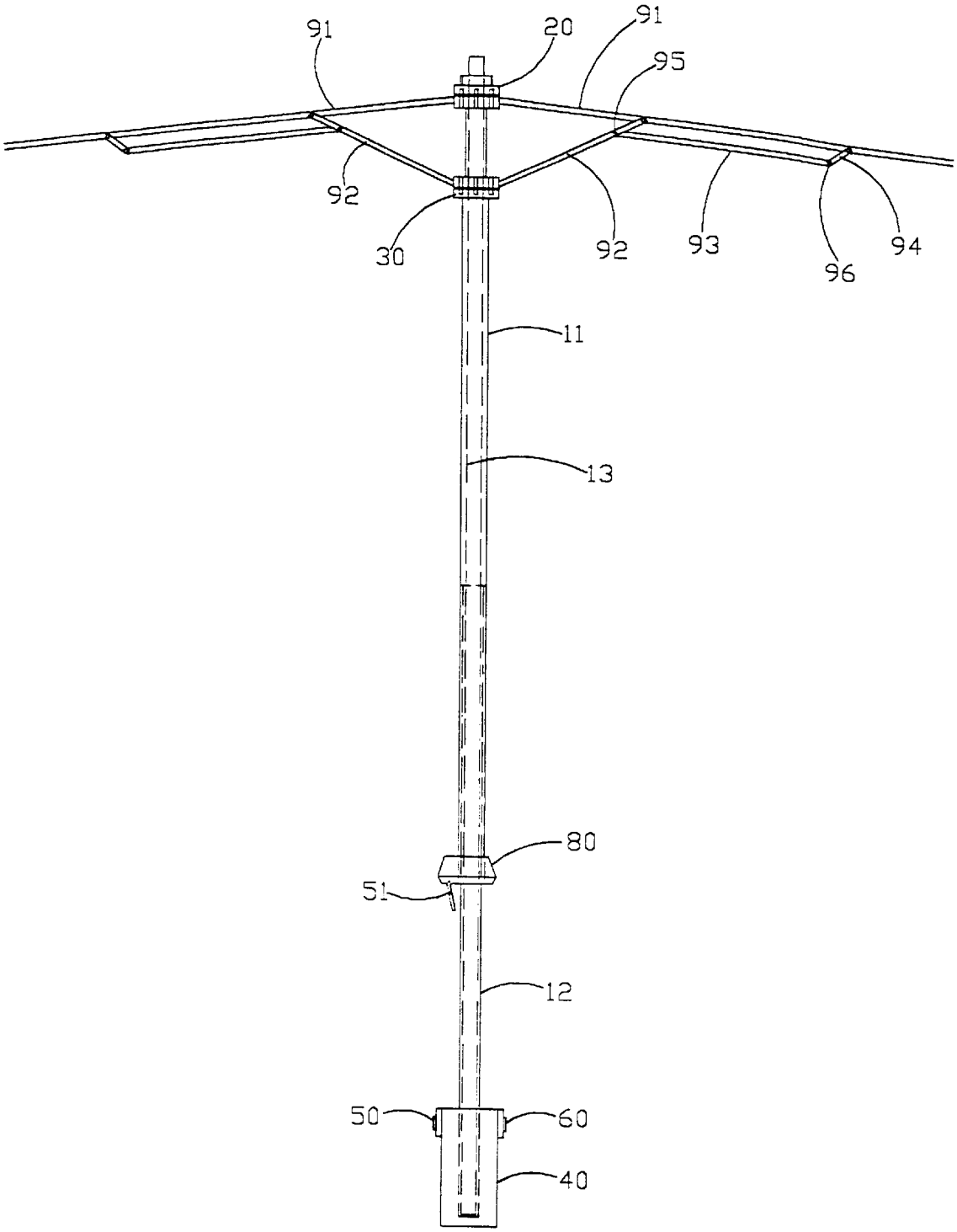
FIG. 4 is a side view of the self-opening/closing umbrella in an open state.

Referring to FIGS. 1 and 4, a self-opening/closing umbrella in accordance with the present invention generally includes a main frame 10 consisting of an outer tube 11, a middle tube 12 partially received in the outer tube 11, and an inner tube 13 partially received in the middle tube 12. As illustrated in FIGS. 1 and 2, a solid end face of a lower end 125 of the middle tube 12 is securely attached to a bottom 41 of a sleeve-like handle 40 by a rivet 42. An upper end of the middle tube 12 is received in an intermediate portion of the outer tube 11. A lower end of the inner tube 13 is mounted in the middle tube 12 and an upper end of the inner tube 13 extends beyond: the middle tube 12 and the outer tube 11.

A base 20 is securely mounted to the upper end of the outer tube 13. A plurality of ribs 91 each have an end pivotally mounted to the base 20 for supporting a gore or panel (not shown), as shown in FIGS. 1 and 4. A runner 30 is securely mounted to the upper end of the outer tube 11 to move therewith. The runner 30 is around the inner tube 13 and slidable along a longitudinal direction of the inner tube 13. In this embodiment, the runner 30 includes a tubular portion 32 that is located between the inner tube 13 and the outer tube 11. A compression spring 70 for opening and closing the umbrella is mounted around the inner tube 13 and attached between the upper end of the middle tube 12 and an end face of the tubular portion 32 of the runner 30. A plurality of'stretchers 92 each have an end pivotally mounted to the runner 30, and the other end of each stretcher 92 is pivotally attached to an intermediate portion of an associated rib 92, as shown in FIG. 4. The compression spring 70 has a minimum length when the umbrella is in a closed state shown in FIG. 1.

Referring to FIGS. 1 and 2, a follower 80 is mounted around a lower portion of the outer tube 11 to move therewith. The follower 80 is located slightly above the handle 40 when the umbrella is in the closed state shown in FIG. 1. A first hook 51 is pivoted to the follower 80 at 53 (FIG. 2) and includes a first end 55 and a hooked second end 52. A spring 54 has a first end received in a recess 54 in the follower 80 and a second end attached to the hooked second end 52 for biasing the hooked second end 52 into a radial hole 111 in the outer tube 11 and a radial hole 121 in the middle tube 12, best shown in FIG. 2. An opening button 50 is mounted to an upper end of the handle 40 and includes an inner end operably connected to the first end 55 of the first hook 51. Thus, when a user presses an outer end of the opening button 50, the hooked second end 52 of the first hook 51 is pivoted and thus disengaged from the radial hole 121 in the middle tube 12 to thereby perform an opening function.

A second hook 61 is pivotally mounted in the handle 40 at 63 (FIG. 2) and includes a first end 65 and a hooked second end 62. A spring 64 has a first end attached to an inner wall surface of the handle 40 and a second end attached to the hooked second end 62 for biasing the hooked second end 62 into a radial hole 122 in the middle tube 12 and a radial hole 131 in the inner tube 13, best shown in FIG. 2. A closing button 60 is mounted to the upper end of the handle 40 and includes an inner end operably connected to the first end 65 of the second hook 61. Thus, when a user presses an outer end of the closing button 60, the hooked second end 62 of the second hook 61 is pivoted and thus disengaged from the radial hole 131 in the inner tube 13 to thereby perform a closing function. As can be seen from FIG. 2, a tubular filling block 43 is mounted in the handle 40 and located between the inner wall surface of the handle 40 and an outer periphery of the lower portion of the middle tube 12. Thus, a first space 44 and a second space 45 are provided for receiving and allowing movements of the first end 55 of the first hook 50 and the second hook 61, respectively. The spring 64 is mounted in the second space 45 of the handle 40.

Figure 3:
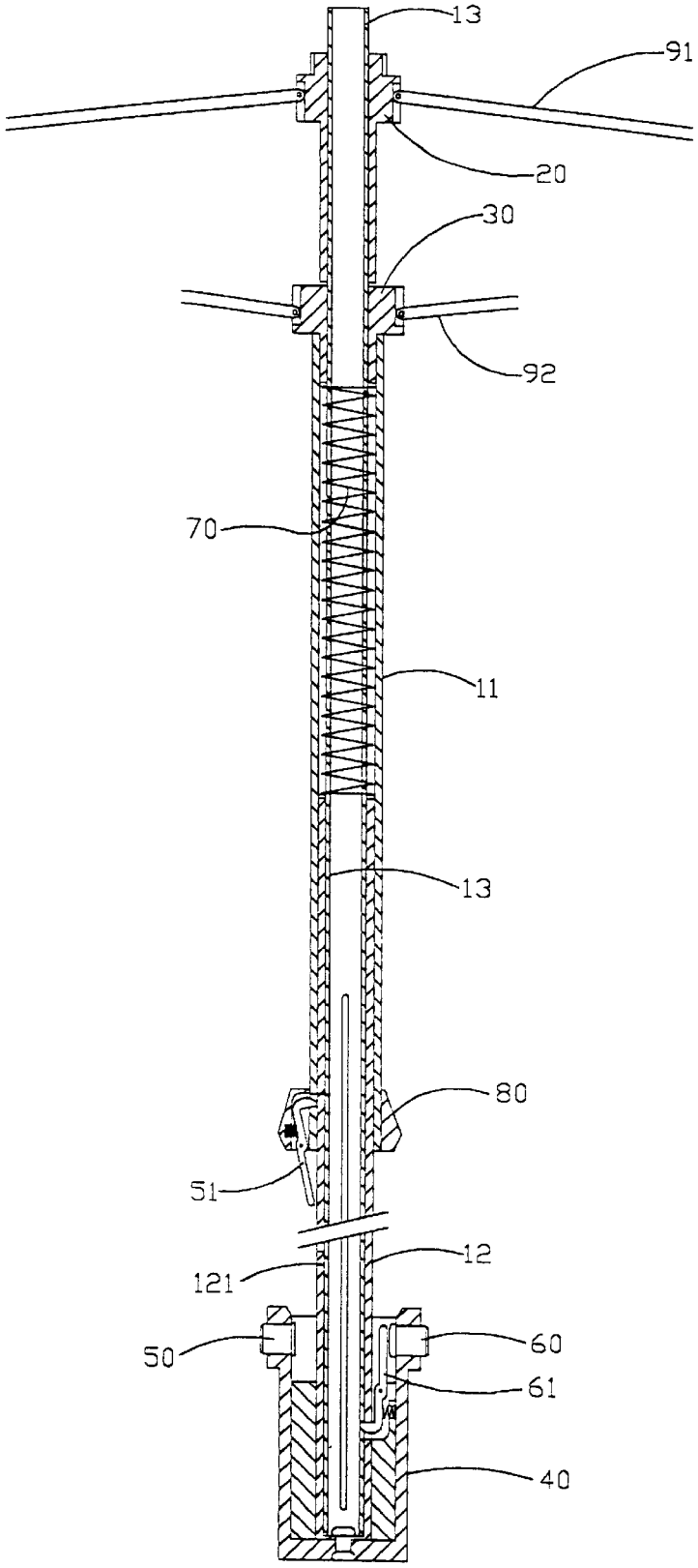
FIG. 3 is a sectional view of the self-opening/closing umbrella in an open state.

The umbrella in FIG. 1 is in a closed state. When the opening button 50 is pushed, the second hooked end 52 of the first hook 51 is disengaged from the radial hole 121 of the middle tube 12, the runner 30 and the outer tube 11 are moved upward to thereby open the umbrella under a first stage of extension of the compression spring 70, as shown in FIGS. 3 and 4.

Figure 5:
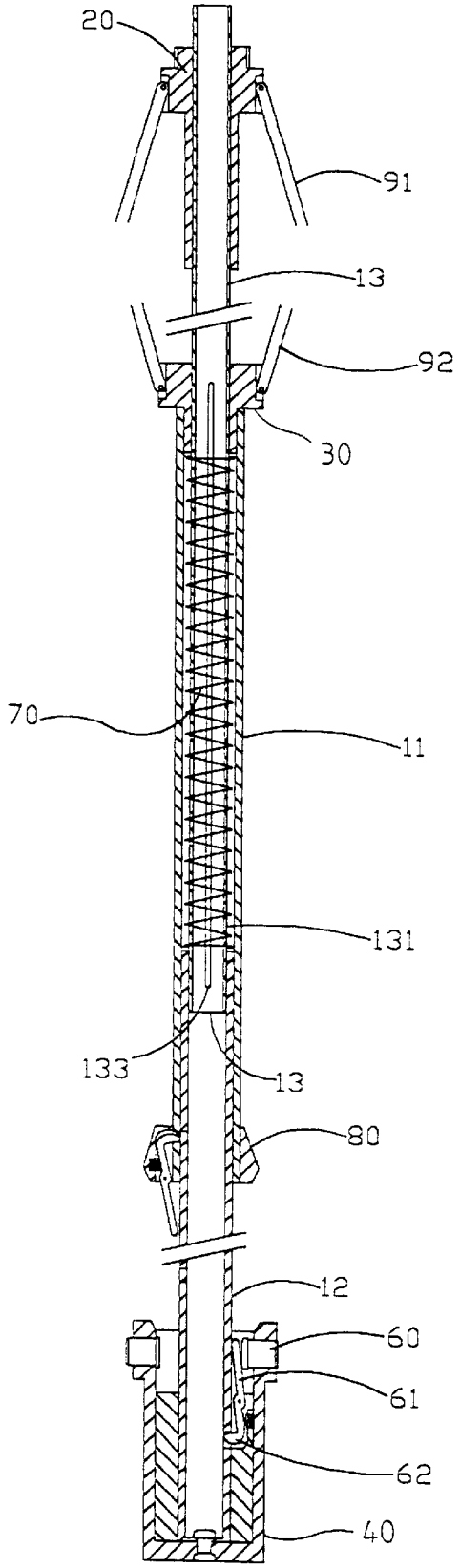
FIG. 5 is a sectional view illustrating a first stage operation for closing the self-opening/closing umbrella in accordance with the present invention.
Figure 6:
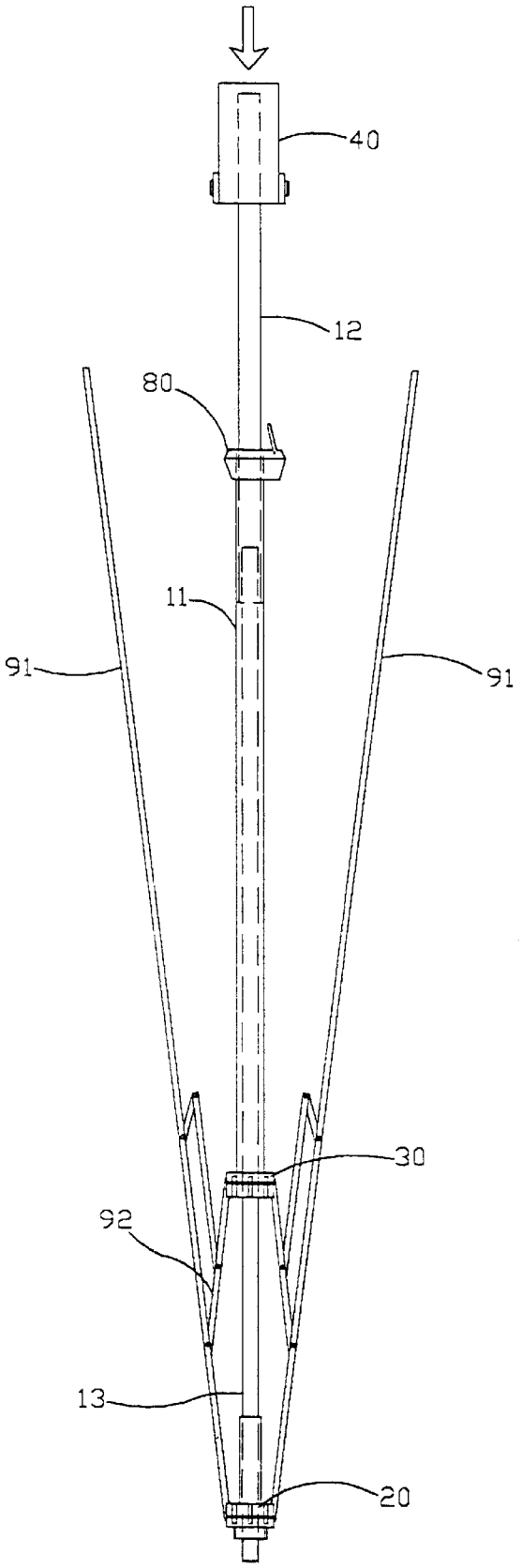
FIG. 6 is a schematic side view illustrating a second stage operation for closing the self-opening/closing umbrella.

When closing the umbrella, the second button 60 is pushed, the hooked second end 62 of the second hook 62 is disengaged from the radial hole 131 of the inner tube 13. The base 20 is pushed upward by the runner 30 under a second stage of extension of the compression spring 70. Namely, the base 30 and the inner tube 13 are moved upward. Thus, the umbrella is moved from a state shown in FIG. 3 to a state shown in FIG. 5, thereby closing the umbrella. The compression spring 70 is returned to its full length. The user may turn the umbrella upside-down and exert a downward force to compress the compression spring 70 for next opening, as shown in FIG. 6.

Referring to FIG. 4, a plurality of first links 93 and a corresponding number of second links 94 are provided to shorten the travel of the runner 30 and to increase the structural strength of the umbrella. Each first link 93 includes a first end pivoted to an associated stretcher 92 at a joint 95. Each second link 94 has a first end pivoted to a second end of the associated first link 93 at a joint 96 and a second end pivoted to an associated rib 91, best shown in FIG. 4.

Figure 7:
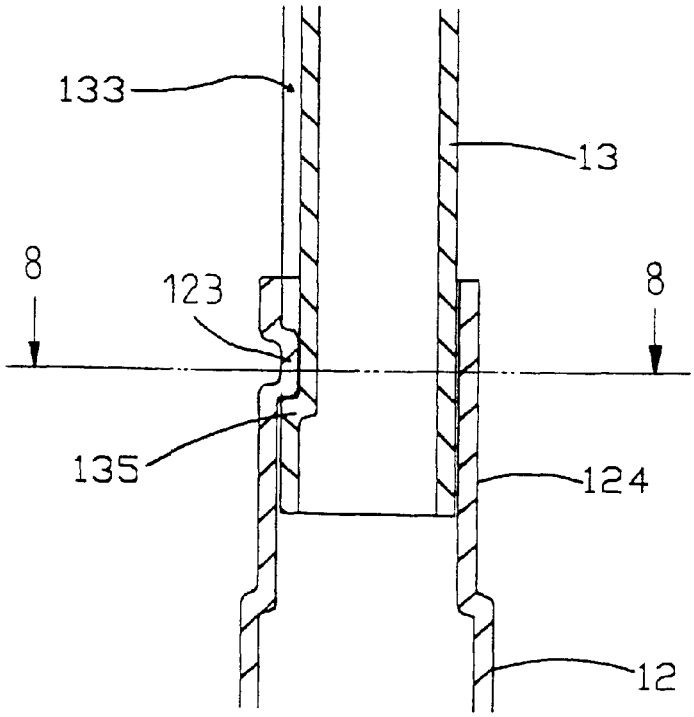
FIG. 7 is a partial sectional view of an upper portion of a middle tube and a lower portion of an inner tube.
Figure 8:
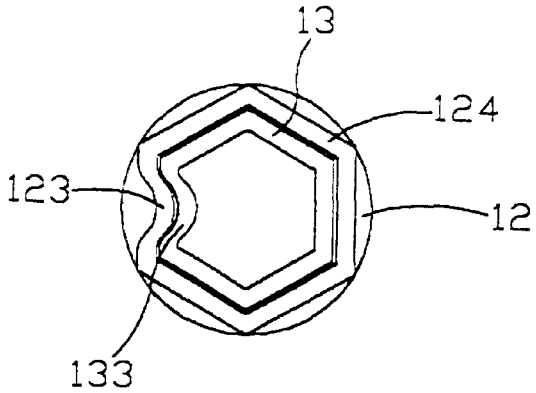
FIG. 8 is a sectional view taken along line 8—8 in FIG. 7.

During the upward movement of the runner 13, guiding means and restraining means can be provided. In an embodiment shown in FIGS. 7 and 8, the upper end of the middle tube 12 has a hexagonal portion 124 and a portion of the inner tube 13 received in the upper end of the middle tube 12 is also hexagonal. The hexagonal portion 124 is punched to define a stop 123 on the middle tube 12. The inner tube 13 is also punched to form a longitudinal recessed . portion 133, thereby forming a shoulder 135 on a lower portion of the inner tube 13. Thus, upward travel of the inner tube 13 is stopped when the shoulder 135 on the inner tube 13 abuts against the stop 123 of the middle tube 12.

According to the above description, it is appreciated that the user may push the opening button for opening the umbrella and push the closing button for closing the umbrella via the use of a single compression spring that has a two-stage extension. The overall structure is simple and easy to manufacture and assemble.

Although the invention has been explained in relation to its preferred embodiment, it is to be understood that many other possible modifications and variations can be made without departing from the scope of the invention as hereinafter claimed.

What is claimed is:

1. A self-opening/closing umbrella comprising:

a handle;

an outer tube mounted outside the handle and including a lower end and an upper end, the outer tube including a first radial hole;

a middle tube partially mounted in the outer tube and including a lower end securely attached to the handle and an upper end in the outer tube, the middle tube including a second radial hole and a third radial hole;

an inner tube partially mounted in the middle tube and including a lower end in the middle tube and an upper end extending beyond the middle tube and the outer tube, the inner tube including a fourth radial hole;

a base securely mounted to the upper end of the inner tube to move therewith, a plurality of ribs each having an end pivotally connected to the base;

a runner securely mounted to the upper end of the outer tube to move therewith, the runner being slidably mounted around the inner tube;

a plurality of stretchers each pivotally connected to the runner and the associated rib;

a compression spring attached between the runner and the upper end of the middle tube;

a first hook pivotally mounted to the lower end of the outer tube and including a first end and a hooked end;

an opening button mounted to the handle and operably connected to the first end of the first hook;

a second hook pivotally mounted to the handle and including a hooked end;

a closing button mounted to the handle and operably connected to the second hook;

wherein when the umbrella is in a closed state, the compression spring is compressed, the hooked end of the first hook is engaged in the first radial hole of the outer tube and the second radial hole of the middle tube, the hooked end of the second hook is engaged in the third radial hole of the middle tube and the fourth radial hole of the inner tube;

wherein when the opening button is pushed, the hooked end of the first hook is disengaged from the second radial hole of the middle tube the first end of the first hook is a disconnected from the opening button, the runner and the outer tube are moved upward with the first hook under a first stage of extension of the compression spring, thereby opening the umbrella to an open state; and wherein when the closing button is pushed while the umbrella is in the open state, the hooked end of the second hook is disengaged from the, fourth radial hole of the inner tube, the base and the inner tube are moved upward under a second stage of extension of the compression spring, thereby closing the umbrella.

2. The umbrella as claimed in claim 1, wherein the handle includes a bottom, the lower end of the middle tube having a solid end face that is riveted to the bottom of the handle.

3. The umbrella as claimed in claim 2, wherein the handle includes a tubular filling block mounted therein, the tubular filling block being located between an inner wall surface of the handle and an outer periphery of the middle tube, thereby defining a first space for receiving the first end of the first hook and a second space for receiving the second hook.

4. The umbrella as claimed in claim 3, further comprising a plurality of first links and a corresponding number of second links, each said first link including a first end pivoted to an associated said stretcher and a second end, each said second link having a first end pivoted to the second end of an associated said first link and a second end pivoted to an associated said rib.

5. The umbrella as claimed in claim 3, wherein the upper end of the middle tube includes a hexagonal portion with a stop, the inner tube including a hexagonal portion with a shoulder, wherein upward movement of the inner tube is stopped when the shoulder of the inner tube abuts against the stop of the middle tube.

6. The umbrella as claimed in claim 1, wherein the first hook is pivotally connected to the outer tube at a middle portion thereof, further comprising a spring for biasing the hooked end of the first hook to engage with the first radial hole of the outer tube and the second radial hole of the middle tube.

7. The umbrella as claimed in claim 6, further comprising a follower securely mounted to the outer tube, the middle portion of the first hook being pivotally connected to the follower.

8. The umbrella as claimed in claim 7, wherein the handle includes a tubular filling block mounted therein, the tubular filling block being located between an inner wall surface of the handle and an outer periphery of the middle tube, thereby defining a space for receiving the first end of the first hook.

9. The umbrella as claimed in claim 8, further comprising a plurality of first links and a corresponding number of second links, each said first link including a first end pivoted to an associated said stretcher and a second end, each said second link having a first end pivoted to the second end of an associated said first link and a second end pivoted to an associated said rib.

10. The umbrella as claimed in claim 8, wherein the upper end of the middle tube includes a hexagonal portion with a stop, the inner tube including a hexagonal portion with a shoulder, wherein upward movement of the inner tube is stopped when the shoulder of the inner tube abuts against the stop of the middle tube.

11. The umbrella as claimed in claim 1, wherein the second hook is pivotally connected to the handle at a middle portion thereof, another end of the second hook being operably connected to the closing button, further comprising a spring for biasing the hooked end of the second hook to engage with the third radial hole of the middle tube and the fourth radial hole of the inner tube.

12. The umbrella as claimed in claim 11, wherein the handle includes a tubular filling block mounted therein, the tubular filling block being located between an inner wall surface of the handle and an outer periphery of the middle tube, thereby defining a space for receiving the second hook.

13. The umbrella as claimed in claim 12, further comprising a plurality of first links and a corresponding number of second links, each said first link including a first end pivoted to an associated said stretcher and a second end, each said second link having a first end pivoted to the second end of an associated said first link and a second end pivoted to an associated said rib.

14. The umbrella as claimed in claim 12, wherein the upper end of the middle tube includes a hexagonal portion with a stop, the inner tube including a hexagonal portion with a shoulder, wherein upward movement of the inner tube is stopped when the shoulder of the inner tube abuts against the stop of the middle tube.

15. The umbrella as claimed in claim 1, further comprising a plurality of first links and a corresponding number of second links, each said first link including a first end pivoted to an associated said stretcher and a second end, each said second link having a first end pivoted to the second end of an associated said first link and a second end pivoted to an associated said rib.

16. The umbrella as claimed in claim 1, wherein the upper end of the middle tube includes a hexagonal portion with a stop, the inner tube including a hexagonal portion with a shoulder, wherein upward movement of the inner tube is stopped when the shoulder of the inner tube abuts against the stop of the middle tube.

* * * * *